United States Patent [19]

Glaser et al.

[11] Patent Number: 4,550,039

[45] Date of Patent: Oct. 29, 1985

[54] METHOD AND APPARATUS FOR MAKING ELECTRIC CONNECTIONS INTO A COMPLIANT SEALED PACKAGE

[75] Inventors: David Glaser, Northbrook; Charles J. Whelchel, Prospect Heights, both of Ill.

[73] Assignee: Lucitron, Inc., Northbrook, Ill.

[21] Appl. No.: 585,238

[22] Filed: Mar. 1, 1984

[51] Int. Cl.[4] ..... H01J 61/06; H01J 61/30; H01J 9/26

[52] U.S. Cl. ..... 428/13; 428/34; 428/69; 428/432; 313/583; 313/635; 445/16; 445/22; 445/23; 445/25; 445/29; 445/44; 156/286; 156/292; 156/300

[58] Field of Search ..... 428/13, 34, 46, 69, 428/76, 432; 313/583, 634, 635, 483, 510, 512; 445/16, 22, 23, 25, 29, 44; 156/286, 292, 300

[56] References Cited

U.S. PATENT DOCUMENTS

| | | | |
|---|---|---|---|
| 3,665,238 | 5/1972 | Esdonk et al. | 313/583 |
| 3,845,347 | 10/1974 | Tanji | 313/583 X |
| 4,339,482 | 7/1982 | Glaser et al. | 428/13 |
| 4,427,479 | 1/1984 | Glaser et al. | 313/583 X |

FOREIGN PATENT DOCUMENTS

| | | | |
|---|---|---|---|
| WO81/00029 | 1/1981 | PCT Int'l Appl. | 313/583 |

*Primary Examiner*—Joseph L. Schofer
*Assistant Examiner*—F. M. Teskin
*Attorney, Agent, or Firm*—Edmond T. Patnaude

[57] ABSTRACT

A flat panel display of the type in which an electrode structure is disposed in a vacuum chamber between a front glass panel and a foil backing sheet is provided with a gas-impervious electrical connector sealably mounted over an opening in the foil sheet so as to be physically held in place within the panel by the ambient pressure on the exterior side of the connector.

8 Claims, 5 Drawing Figures

METHOD AND APPARATUS FOR MAKING ELECTRIC CONNECTIONS INTO A COMPLIANT SEALED PACKAGE

The present invention relates in general to display panels of the type disclosed in U.S. Pat. No. 4,339,482, and it also relates to a new and improved method for making electrical connections to the electrical elements disposed in the low-pressure cavities within such panels.

BACKGROUND OF THE INVENTION

In the above referenced patent there is described a display panel in which the display-producing structure is disposed in a low pressure cavity located between a rigid, glass panel and a metal-foil backing sheet. Ambient pressure on the exterior surface of the foil presses the foil sheet against the underlying display-producing structure and thus presses the underlying structure against the glass panel, thereby to hold the display-producing structure in a fixed position against the glass panel.

In the prior art devices the external control circuits have been connected to the electric elements within the panel by means of lead wires or the like which extend through a sealing structure affixed to the glass panel in such a way that one end of each lead wire is located within the sealed cavity and the other end is located on the outside of the panel. Suitable multi-pin connectors have been connected to the lead wires and mechanically mounted exteriorly of the panel to facilitate the making of electric connections between the external control circuits and the electrical elements in the panel.

SUMMARY OF THE INVENTION

Briefly, in accordance with the present invention, the headers of one or more gas-impervious multi-pin terminal connectors are sealably mounted to the foil backing sheet of a display panel and extend across openings in the foil sheet. The connectors include gas-impervious headers through which solid metal connector pins sealably extend whereby gas cannot leak through the connectors into the low-pressure cavity within the panel. During assembly of the associated panel and before the foil backing sheet has been sealed to the front glass panel, the inner ends of the connector pins are electrically connected to the electrical elements positioned against the glass panel. Thereafter, when the backing sheet has been sealed to the glass panel and the cavity between the glass panel and the foil backing sheet is evacuated, the ambient pressure on the exterior face of the connector presses the connector firmly in place against the internal structure of the panel. The connector is thus held permanently in place in the panel by ambient pressure. The frit seals and the like which surrounded the wire leads in the prior art panels are thus eliminated, thereby reducing the manufacturing cost of the panels and also reducing the chance of gas leaking into the panel.

In a preferred embodiment of the invention, a compressible mat or blanket is formed of an insulating material and positioned between the inner side of the terminal connectors and the display-producing structure. Where desired, the lead wires from the electrical elements to the terminal connector pins may be routed through the insulating blanket.

Those skilled in the art will thus recognize that the terminal connector mounting system of the present invention reduces the cost of manufacturing display panels, provides a more rigid mount for the terminal connectors, and enables a more efficient routing of lead wires from the electrode structure of the panel to the terminal connectors.

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
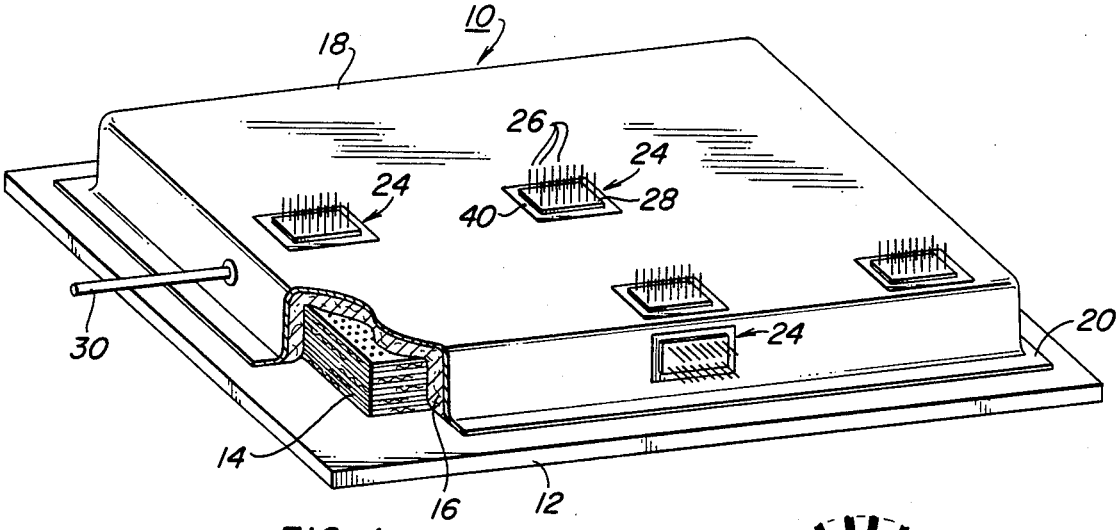
FIG. 1 is a perspective view, partly broken away, particularly showing the rear side of a flat display panel embodying the present invention.

Referring particularly to FIG. 1, a flat panel display 10 is shown in the process of manufacture and may be seen to include a rigid, glass panel 12 which constitutes the front face of the panel. A suitable display-producing structure 14 is positioned against the upper face of the glass panel 12, and an insulating blanket 16 is draped over the electrode structure 14. A preformed, metal foil sheet 18 is disposed over the blanket 16 and the display-producing structure, and the peripheral flange 20 of the foil preform is hermetically sealed in any suitable manner to the glass panel 12 throughout a continuous area surrounding the viewing area of the panel. U.S. Pat. No. 4,339,482 discloses one manner of providing such a seal. In the completed panel the cavity between the foil sheet and the glass panel contains the electrode structure 14 and the blanket 16 and is maintained at a reduced pressure of, for example, 1.0 Torr., wherefore ambient pressure on the exterior side of the foil backing sheet presses the backing sheet tightly against the blanket 16 to hold the display-producing structure in a fixed position against the rear face of the glass panel.

The display-producing structure may be of any type which operates at less than atmospheric pressure, but is preferably of the general type disclosed in U.S. Pat. No. 4,393,334. However, the present invention is not limited to any particular configuration for producing the images to be viewed through the glass panel 12.

In accordance with the present invention a plurality of terminal connectors 24 are sealably mounted to the foil backing sheet over suitable openings in the sheet. The connectors 24 are commercially available, hermetic feed-through packages having a plurality of solid metal connector pins 26 which extend through a gas impervious flat header plate or support 28. The plate 28 is sealed about its periphery to the foil sheet 18, and the connector pins are insulated from and sealed to the header plate in the manner more fully described hereinafter. Flexible conductive leads, suitably formed of wire, ribbon or the like, are electrically connected between the terminal connector pins 26 and the electrodes of the display-producing structure. FIG. 1 shows a plurality of terminal connectors 24 in typical locations for optimum routing of the leads from the connector pins to the electrode terminals.

After the electric connections to the electrodes have been made and the preformed foil backing sheet 18 has been sealed to the glass panel, a vacuum is drawn through a tubulation 30 sealably extending through the sheet 18. Ambient pressure thus presses the foil sheet 18 and the connector terminals toward the rigid glass panel. Depending on the rigidity of the display-producing structure, special support brackets (not shown) may be required to position the terminal connectors at the desired locations when they are pressed toward the rear face of the glass panel 12. After suitable backfilling to achieve the desired low-pressure atmosphere for the electrode system, the tubulation 30 is sealed off in the well known manner.

The hermetic feed-through terminal connectors are commercially available in several different sizes and configurations and can mate with various kinds of commercially available connectors, thereby further reducing the manufacturing cost of the panel and associated control system.

Figure 2:
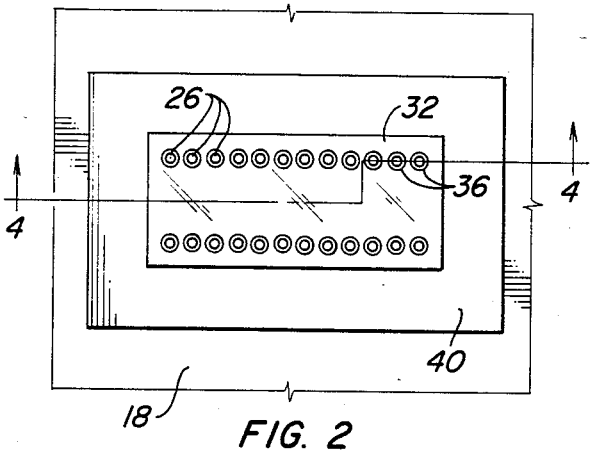
FIG. 2 is a plan view of the outside face of one of the terminal connectors and the surrounding portion of the foil backing sheet of the panel illustrated in FIG. 1.
Figure 3:
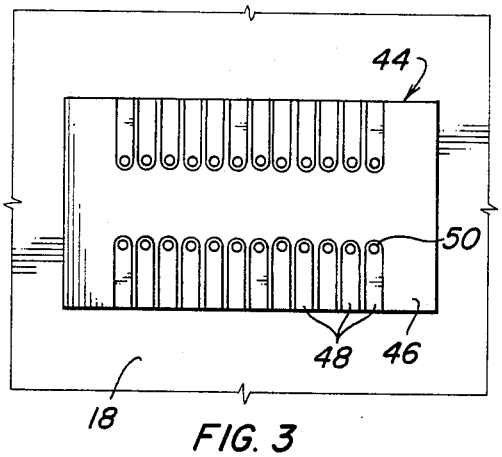
FIG. 3 is a plan view of the inside face of the terminal connector of FIG. 2, the associated lead wires to the connector pins not being shown.
Figure 4:
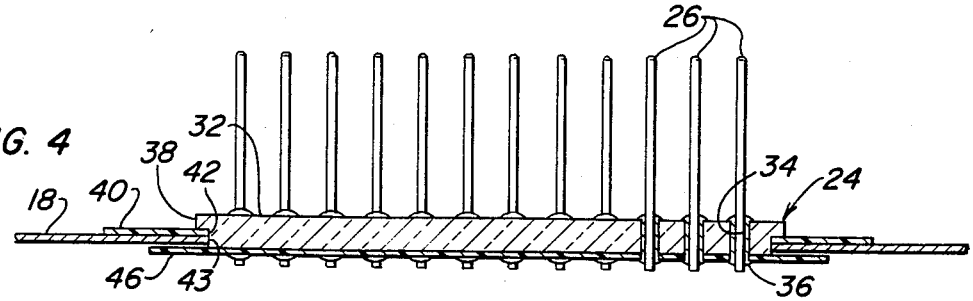
FIG. 4 is a cross-sectional, elevational view taken along the line 4—4 in FIG. 2.

Referring now to FIGS. 2, 3 and 4, one of the terminal connectors 24 is shown in greater detail, and the manner in which it is sealably connected to the foil backing sheet is also shown. As there shown, the connector 24 includes a metallic header plate 32 having two rows of holes 34 through which the feed-through connector pins 26 extend. The pins 26 are insulated from the header plate 32, held in place, and hermetically sealed to the plate 32 by beads 36 of a rigid, insulating material such as glass or ceramic.

As best shown in FIG. 4, the header plate 32 includes a peripheral lip 38, and a flat, metal flange 40 having a central, rectangular opening 42 complimentary to the bottom face of the header 32 is positioned against the lip and sealably affixed thereto by soldering, brazing, welding or the like to effect a hermetic metal-to-metal seal between the header 32 and the flange 40. The flange 40 is in turn hermetically sealed to the foil backing sheet 18 by soldering or by other means, with the bottom portion of the header 32 extending through an opening 44 in the sheet 18.

In order to facilitate the making of the necessary electrical connections betwen the connector pins 26 and the electrodes within the panel, an interconnect solder pad 46 is positioned against the bottom face of the header 32 with the connector pins 26 extending therethrough.

As best shown in FIG. 3, the interconnect solder pad 44 comprises an insulating sheet 46 formed of a suitable insulation material such as Kapton on which is deposited a plurality of conductive pads 48. The pads 48 may be applied to the sheet 46 by means of well known printed circuit techniques. Each of the pads 48 has a hole 50 through which one of the pins 26 extends when the solder pad is connected to the terminal connector 24 as shown in FIG. 4. Solder connections are provided between the pads 48 and the respective pins 26.

Figure 5:
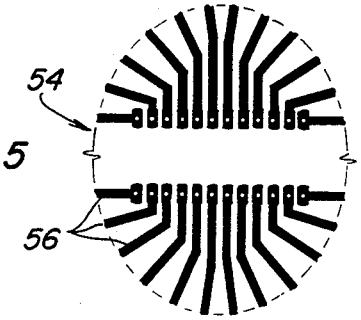
FIG. 5 is a plan view like that of FIG. 3 but showing an alternative terminal connector construction.

Referring to FIG. 5 there is shown an alternative solder pad 54 wherein the individual solder pads 56 fan out to provide greater mutual spacing at the extremities of the pads where the leads are to be connected to the pads. The greater spacing makes assembly of the panel easier and reduces the risk of short circuits between the pads.

Electrical connections from the connector pins 26 to the flexible leads which are in turn connected to the electrodes of the display-producing structrue may be made by conventional soldering techniques or alternatively may be made by press-fit connectors which fit onto the connector pins 26. Such press-fit connectors may be either single connectors, one for each pin, or may be arranged as multiple connectors in a suitable insulator, like the connecting plugs used on the outside of the hermetic feed-through connectors 24. As other alternatives, the connections between the flexible leads and the connector pins may be made by welding or by the use of suitable conductive cements.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A method of fabricating an electrical device containing a display-producing structure located within a sealed enclosure, said display-producing structure including an electrical element, comprising the steps of providing a hermetic seal between a conductive element and a gas-impervious support member through which said conductive element extends, positioning said support member over an opening in a foil sheet, hermetically sealing said support member to said foil sheet throughout a continuous area of said foil sheet surrounding said opening, electrically connecting said electrical element to said conductive element, mounting said display-producing structure in proximity to a rigid, gas-impervious translucent member, sealing said foil sheet to said gas-impervious translucent member to define in conjunction with said gas-impervious translucent member a sealable cavity in which said display-producing structure is disposed, and reducing the pressure in said cavity below ambient pressure.

2. The method according to claim 1 comprising the further step of positioning an insulating blanket over said display-producing structure before sealing said foil sheet to said rigid gas-impervious translucent member.

3. The method according to claim 1 wherein said rigid, gas-impervious translucent member comprises a glass panel.

4. The method according to claim 3 comprising the further step of positioning an insulating blanket between said gas-impervious support member and said display-producing structure before sealing said foil sheet to said rigid gas-impervious translucent member, and said step of electrically connecting said electrical element to said conductive element is carried out by extending a conductive lead through said blanket and connecting respective ends thereof to said electrical element and to said conductive element.

5. The method according to claim 1 wherein said display-producing structure includes a plurality of additional electrical elements, comprising providing a hermetic seal between a plurality of additional conductive elements and said gas-impervious support member through which said additional conductive elements extend, and electrically connecting said additional conductive elements to said additional electrical elements.

6. The method according to claim 5 comprising the further steps of providing an insulating member having thereon a plurality of mutually divergent conductors, said insulating member being mechanically mounted on said conductive elements and said conductive elements being electrically connected to said divergent conductors, and electrically connecting conductive leads between said conductors and said electrical elements.

7. A flat-panel display, comprising in combination a rigid glass panel, a display-producing structure positioned against one face of said panel, said display producing structure including an electrical element, a gas-impervious foil sheet positioned over said display-producing structure and hermetically sealed to said glass panel throughout a continuous area surrounding said display-producing structure to provide a cavity between said sheet and said panel in which said display-producing structure is located, an opening in said foil sheet, a gas-impervious member disposed across said opening and hermetically sealed to said foil sheet throughout a continuous area surrounding said opening, at least one conductive element extending through said gas-impervious member into said cavity and hermetically sealed to said gas-impervious member, means electrically connecting a portion of said conductive element located within said cavity to said electrical element, and the pressure within said cavity being less than ambient pressure.

8. A flat-panel display according to claim 7, further comprising an insulating blanket positioned between said foil sheet and said display-producing structure.

* * * * *